US008444443B2

(12) United States Patent
Schafmeister

(10) Patent No.: US 8,444,443 B2
(45) Date of Patent: May 21, 2013

(54) ELECTRICAL CONNECTION TERMINAL

(75) Inventor: Arndt Schafmeister, Dörntrup (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 240 days.

(21) Appl. No.: 13/121,460

(22) PCT Filed: Aug. 27, 2009

(86) PCT No.: PCT/EP2009/006218

§ 371 (c)(1),
(2), (4) Date: Mar. 29, 2011

(87) PCT Pub. No.: WO2010/031491

PCT Pub. Date: Mar. 25, 2010

(65) Prior Publication Data

US 2011/0223795 A1 Sep. 15, 2011

(30) Foreign Application Priority Data

Aug. 27, 2008 (DE) ..... 10 2008 039 868

(51) Int. Cl.
*H01R 4/48* (2006.01)

(52) U.S. Cl.
USPC ..... 439/725; 439/441

(58) Field of Classification Search
USPC ..... 439/437–441, 725–729
See application file for complete search history.

(56) References Cited

U.S. PATENT DOCUMENTS

| | | | | |
|---|---|---|---|---|
| 6,341,989 | B1 * | 1/2002 | Jaag | 439/725 |
| 6,689,955 | B2 | 2/2004 | Doutaz | |
| D500,742 | S * | 1/2005 | Stadler | D13/147 |
| 7,354,319 | B2 * | 4/2008 | Camino et al. | 439/828 |
| 7,438,587 | B2 | 10/2008 | Germani | |
| 7,766,689 | B2 * | 8/2010 | Knoerrchen et al. | 439/437 |
| 8,129,641 | B2 * | 3/2012 | Majewski et al. | 200/335 |
| 8,241,072 | B2 * | 8/2012 | Hayashi et al. | 439/725 |

FOREIGN PATENT DOCUMENTS

| | | | |
|---|---|---|---|
| DE | 44 08 985 | A1 | 9/1994 |
| DE | 196 13 557 | A1 | 6/1997 |
| DE | 196 11 762 | A1 | 10/1997 |
| DE | 198 34 681 | C1 | 5/2000 |
| DE | 203 13 041 | U1 | 10/2003 |
| DE | 102 37 107 | A1 | 2/2004 |
| EP | 0 837 526 | A1 | 4/1998 |

* cited by examiner

*Primary Examiner* — Truc Nguyen
(74) *Attorney, Agent, or Firm* — Roberts Mlotkowski Safran & Cole, P.C.; David S. Safran

(57) ABSTRACT

An electrical connection terminal having a clamping spring, a metal part and a housing accommodating the clamping spring and the metal part and having at least one conductor insertion opening, the clamping spring having a clamping leg, an operating leg and a back connecting the two legs to each other, the clamping leg, together with the metal part, forming a clamping point for a stripped conductor, the clamping spring being pivotably mounted in such a way that the clamping spring is movable from a first (open) position to a second (closed) position. An operating element is pivotably mounted in the housing in such a way that the operating element can be moved from a first position to a second position, and that the clamping spring is pivoted out of its first position to its second position when the operating element is pivoted from the first position to the second position.

13 Claims, 7 Drawing Sheets

ELECTRICAL CONNECTION TERMINAL

BACKGROUND OF THE INVENTION

1. Field of the Invention

The invention relates to an electrical terminal with a clamping spring, with a metal part and with a housing which holds the clamping spring and the metal part and which has at least one conductor insertion opening, the clamping spring having a clamping leg, an actuating leg, and a back which connects the two legs to one another, the clamping leg with the metal part forming a clamping site for a stripped conductor which is to be connected, the clamping spring being supported to be able to pivot in the housing or on the metal part such that the clamping spring can be moved out of a first (opened) position into a second (closed) position, and a stripped electrical conductor which has been inserted through the conductor insertion opening in the first position of the clamping spring being insertable into the clamping site, without the clamping leg having to be deflected against its spring force, and in the second position of the clamping spring being clamped in an electrically conductive manner between the end of the clamping leg and the metal part.

2. Description of Related Art

Electrical terminals are known in a plurality of embodiments. Terminals can be made, for example, for connection of an electrical conductor to a circuit board as a so-called print terminal or for connection to another conductor as a terminal block. The clamping springs are both loop-shaped clamping springs, so-called tension spring terminals, as well as U-shaped or V-shaped clamping springs, so-called leg springs, into which rigid conductors or conductors provided with one ferrule can be directly inserted, i.e. without the clamping site needing to be opened beforehand with a tool. In the known loop-shaped tension springs, according to their name, the conductor which is to be connected is pulled against a busbar by the clamping leg. In contrast, for U-shaped or V-shaped clamping springs the conductor to be connected is pressed by the clamping leg against the busbar or one region of the metal part.

To actuate the tension spring terminal, an actuating tool, for example, a screw driver, is necessary which is inserted into an actuating shaft to open the terminal. In doing so, the tip of the screwdriver tensions the tension spring, as a result of which the clamping site opens. A conductor which is to be connected can be inserted into the clamping leg through a recess and is clamped against a busbar connected to the tension spring by the lower edge of the recess after the actuating tool is removed. Here, terminals are also known in which an actuating element is located in the housing in order to facilitate the opening of the tension spring terminal. This terminal, with an actuating thrustor, is known, for example, from German Patent Application DE 10 2007 009 082 A1 and corresponding to U.S. Pat. No. 7,438,587 B2.

German Utility Model DE 203 13 041 U1 discloses an electrical terminal with an essentially U-shaped clamping spring and a metal part. In this terminal, the clamping spring, which can also be called a leg spring, acts as a compression spring which presses a conductor to be connected against a contact element or a busbar by the spring force of the clamping spring and as a result establishes the electrically conductive contact between the conductor and the contact element or the busbar.

These terminals are also called edge socket terminals since they enable the insertion of a rigid conductor or a conductor which is provided with a ferrule into the clamping site without the clamping site having to be opened with an actuating tool (see, brochure "Series terminals CLIPLINE 2005, Page 20 from Phoenix Contact GmbH & Co. KG). Here, the clamping leg is deflected against its spring force by the insertion of the conductor; the insertion of the conductor is thus associated with a certain expenditure of force. In doing so, a compromise must always be found between a high spring force which is desirable for good electrical contact-making on the one hand and a low spring force of the clamping leg which facilitates insertion of the conductor, on the other.

The initially described electrical terminal is known from German Patent Application DE 196 13 557 A1. In this terminal, the clamping spring is pivotally arranged in the U-shaped metal part, for which the clamping spring in the region of the back has two lateral projections which are supported in the corresponding receivers in the U-legs of the metal part. The terminal which is known from German Patent Application DE 196 13 557 A1 has the advantage that the shorter first leg of the clamping spring which acts as the clamping leg when the stripped conductor which is to be connected is being inserted need not be deflected against its spring force so that even a flexible conductor can be inserted into the electrical terminal without using a tool. The disadvantage in this electrical terminal is, however, that the actuation of the clamping spring is relatively tedious, especially when the terminal has relatively small dimensions.

Since, to open the clamping site, it is moreover necessary for the end of the actuating leg to be freely accessible so that the end can be actuated by hand, there is the danger that the mechanic will injure himself on the end of the clamping spring which projects out of the housing. This danger prevails especially when the clamping spring is made of metal since then the end of the actuating leg projecting out of the housing is connected in an electrically conductive manner to the connected conductor.

SUMMARY OF THE INVENTION

Therefore, the object of this invention is to provide an electrical terminal of the initially described type which enables simple, but still reliable, connection of an electrical conductor, and especially the actuation of the clamping spring should take place in an especially user-friendly manner.

This object is achieved in the initially described electrical terminal by the actuating element being arranged in the housing to be able to pivot such that the actuating element can be moved out of a first position into a second position and by the clamping spring being pivoted out of its first position into its second position when the actuating element is pivoted out of the first position into the second position.

The electrical terminal in accordance with the invention thus differs from the terminal known from the prior art, first of all, in that an additional actuating element is supported in the housing to be able to pivot, pivoting of the actuating element out of the first position into a second position causing the pivoting of the clamping spring out of the first position into the second position, in which a stripped electrical conductor which has been inserted into the clamping site is clamped in an electrically conductive manner between the end of the clamping leg and the metal part. If the actuating element is made of an electrically nonconductive material, especially of plastic, in this way, unwanted touching of voltage-carrying parts, especially the clamping spring, which is made of metal, can be reliably prevented since the actuating leg of the clamping spring need not be accessible directly from the outside.

According to one preferred configuration of the invention, the actuating element can also be pivoted out of the second position into the first position, the clamping spring being pivoted back out of its second position into its first position when the actuating element is pivoted out of the second position into the first position. Thus, by pivoting the actuating slide the electrical terminal or the clamping site can be both closed and also opened so that a connected electrical conductor can also be pulled out of the electrical terminal again.

Preferably, the clamping spring and the actuating element are arranged and supported in the housing such that the direction in which the clamping spring turns and the direction in which the actuating element turns are opposite one another when the actuating element is pivoted. If the actuating element is pivoted clockwise to close, in this way, the clamping spring is pivoted counterclockwise. This arrangement of the clamping spring and the actuating element in which the two components engage one another can yield a compact construction of the terminal.

The clamping force which is necessary for clamping, and thus for electrically conductive contact-making of the conductor which is to be connected, is implemented in the terminal in accordance with the invention in that in the second position of the clamping spring the clamping leg at least with the electrical conductor inserted is deflected against the spring force of the clamping spring so that the clamping leg presses the inserted electrical conductor against a corresponding contact site which is formed by a corresponding region of the metal part.

According to another advantageous configuration of the terminal in accordance with the invention, the clamping spring can be locked in its second position. This prevents the clamping spring from unintentionally springing back into its first position again after pivoting into the second position as a result of its freely pivotable arrangement in the housing or in the metal part so that the electrical connection of an inserted conductor has been released again.

To lock the clamping spring in the second position, a retaining section which is bent in the direction of the clamping leg is preferably made on the free end of the actuating leg. Moreover, the metal part, in addition to the clamping section which forms the clamping site for the conductor with the clamping leg, still has a retaining section which is bent away from the clamping section. In this case, the retaining section of the clamping spring and the retaining section of the metal part are made such that they lock with one another in the second position of the clamping spring. For this purpose, on the retaining section of the actuating leg preferably at least one catch element is made and on the retaining section of the metal part at least one corresponding mating catch element is made.

When the clamping spring is pivoted out of its first position into its second position, the retaining section on the actuating leg of the clamping spring is deflected such that the catch element which is made on the retaining section engages the mating catch element which is made on the retaining section of the metal part. In order to deflect the retaining section of the actuating leg accordingly, in the housing or on the actuating element a corresponding guide edge is advantageously made, along which the retaining section slides when the clamping spring is pivoted out of the first position into the second position.

In order to be able to pull a connected electrical conductor out of the terminal again in the above described configuration of the electrical terminal in accordance with the invention, first the locking of the clamping spring in the second position must be released. To do this, the actuating element is preferably made such that when pivoted out of the second position into the first position it deflects the retaining section of the actuating leg such that the locking between the retaining section of the clamping spring and the retaining section of the metal part is released. If the locking is released, the clamping spring pivots by itself in the direction of its first (opened) position as a result of its spring force.

In one preferred configuration of the terminal in accordance with the invention, the retaining section of the actuating leg has two retaining legs which are separated from one another by a slot. Moreover, the actuating element has one actuating wall which is located in the plane of the slot and two unlocking sections which are located laterally next to the actuating wall. In this way, when the actuating element is pivoted out of the second position into the first position first the two unlocking sections can deflect to catch elements formed, for example, as laterally protruding projections on the retaining section of the actuating leg so that the locking is released. Then, the actuating wall can enter the slot in the retaining section of the actuating leg and with its free end can press the actuating leg up so that the clamping spring is pivoted out of its second position into its first position.

According to another advantageous configuration of the terminal in accordance with the invention, in the housing, a stop is made for the actuating leg of the clamping spring, against which the actuating leg lies in the first position of the clamping spring. In this way, damage to the clamping spring by overly wide pivoting of the actuating element is prevented. Moreover, by making the stop, it is apparent to the mechanic when the closing spring has been pivoted into its first, completely opened position in which the clamping site is also completely opened so that an electrical conductor which is to be connected can be easily pushed into the clamping site through the conductor insertion opening in the housing.

With respect to the configuration of the metal part, there are fundamentally different possibilities, for which especially the geometry of the metal part can be matched to the respective use of the terminal, for example, in a terminal block or as a print terminal on a circuit board. According to one preferred configuration of the invention in which the electrical terminal is made as a print terminal, the metal part is connected in an electrically conductive manner to at least one solder terminal pin. Preferably, the metal part is made as a part punched and bent from a conductive flat material, the solder terminal pin or pins being connected in one piece to the metal part.

In particular, there are now a plurality of possibilities for configuring and developing the electrical terminal in accordance with the invention. For this purpose, reference is made to the following description of a preferred exemplary embodiment in conjunction with the drawings.

DETAILED DESCRIPTION OF THE INVENTION

Figure 1:
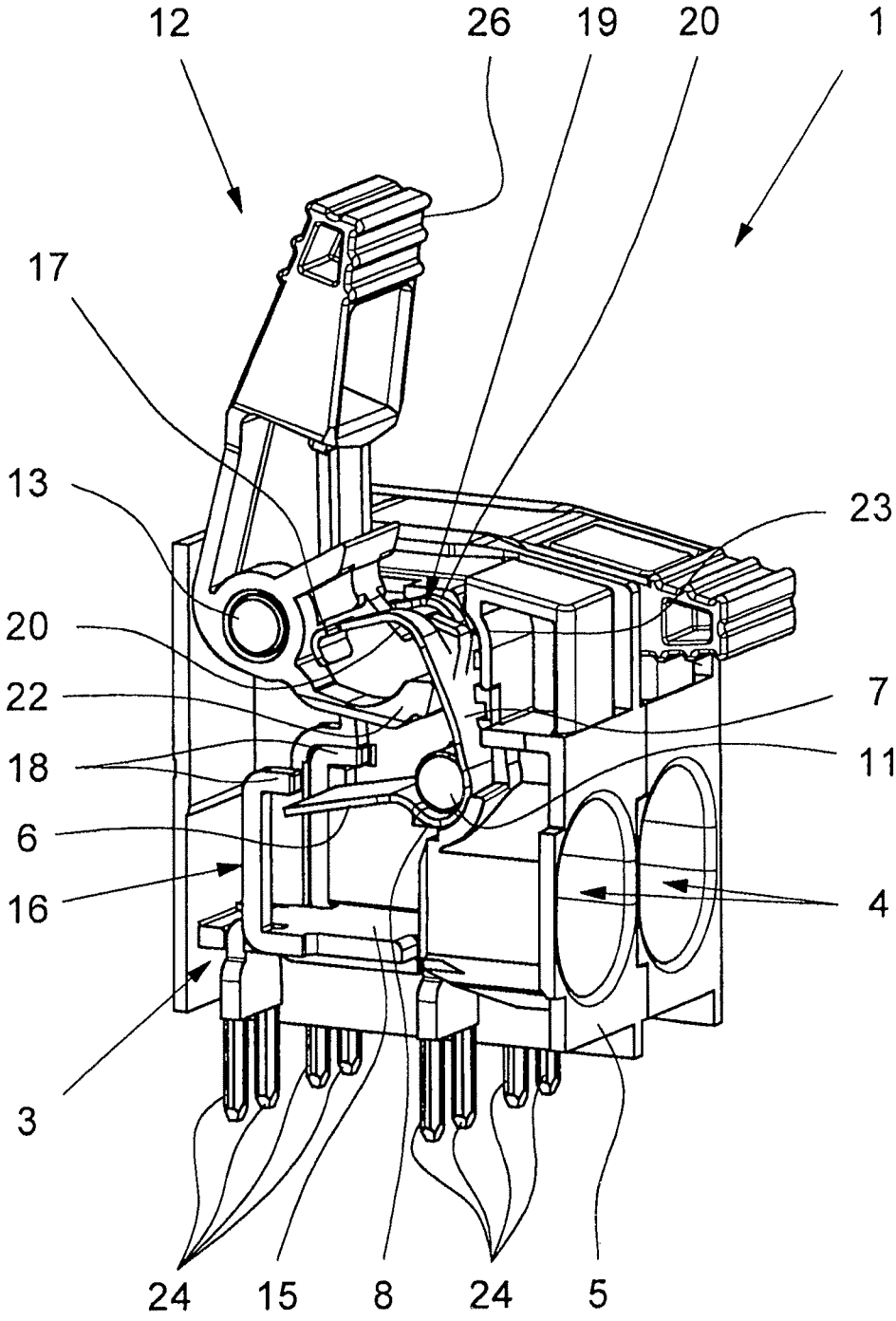
FIG. 1 is a perspective view of two electrical terminals in accordance with the invention which are located next to one another, one terminal being shown in the opened and one terminal being shown in the closed state.

The figures show an electrical terminal 1 which comprises, first of all, a clamping spring 2 and a metal part 3. Both the clamping spring 2 and the metal part 3 can be made as simple punched and bent parts; however, it is not necessary for the same materials to be used for the clamping spring 2 and the metal part 3. The clamping spring 2 and the metal part 3 are located jointly in a housing 5 which has a conductor insertion opening 4 and which is made of an insulating material, especially of plastic.

Figure 2:
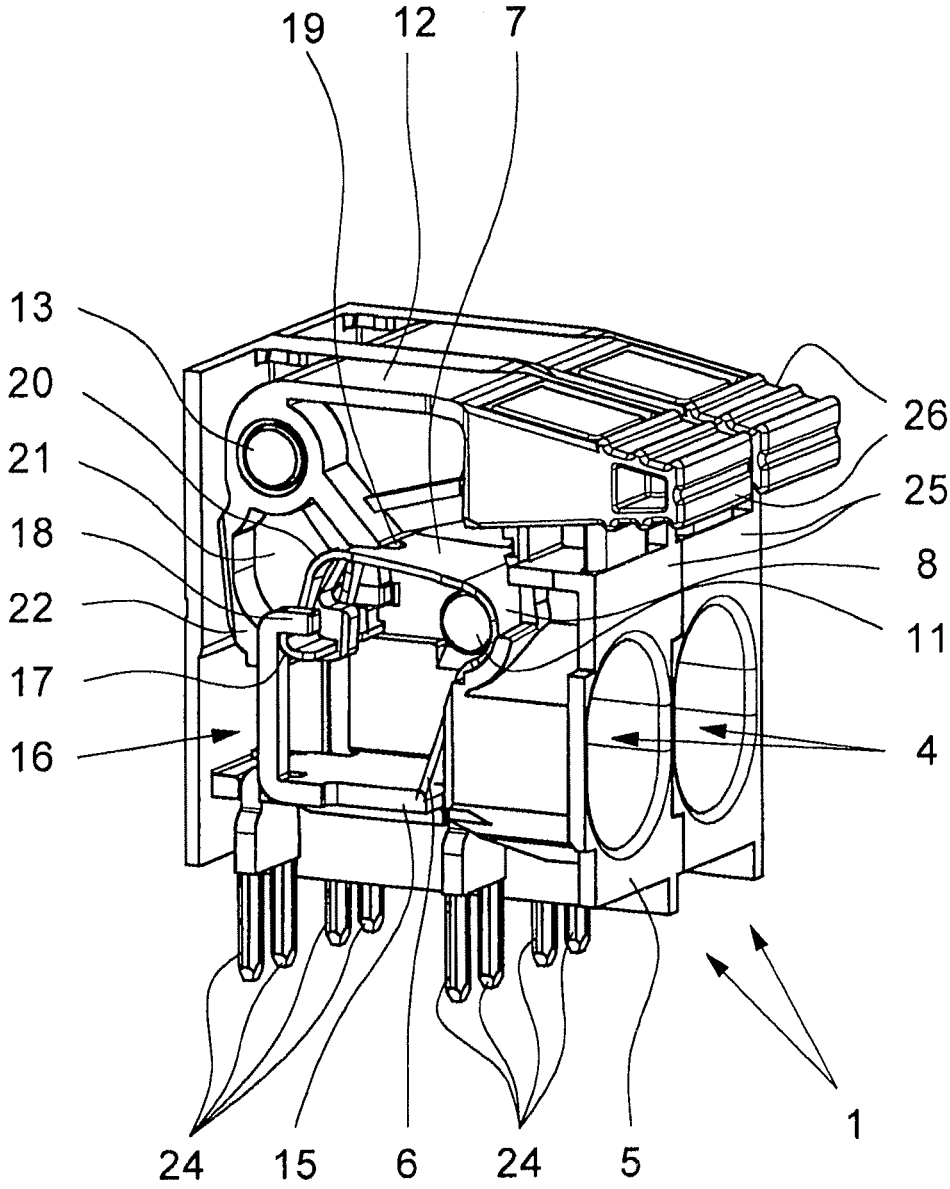
FIG. 2 shows a perspective representation of the two terminals as shown in FIG. 1, both in the closed state.
Figure 3:
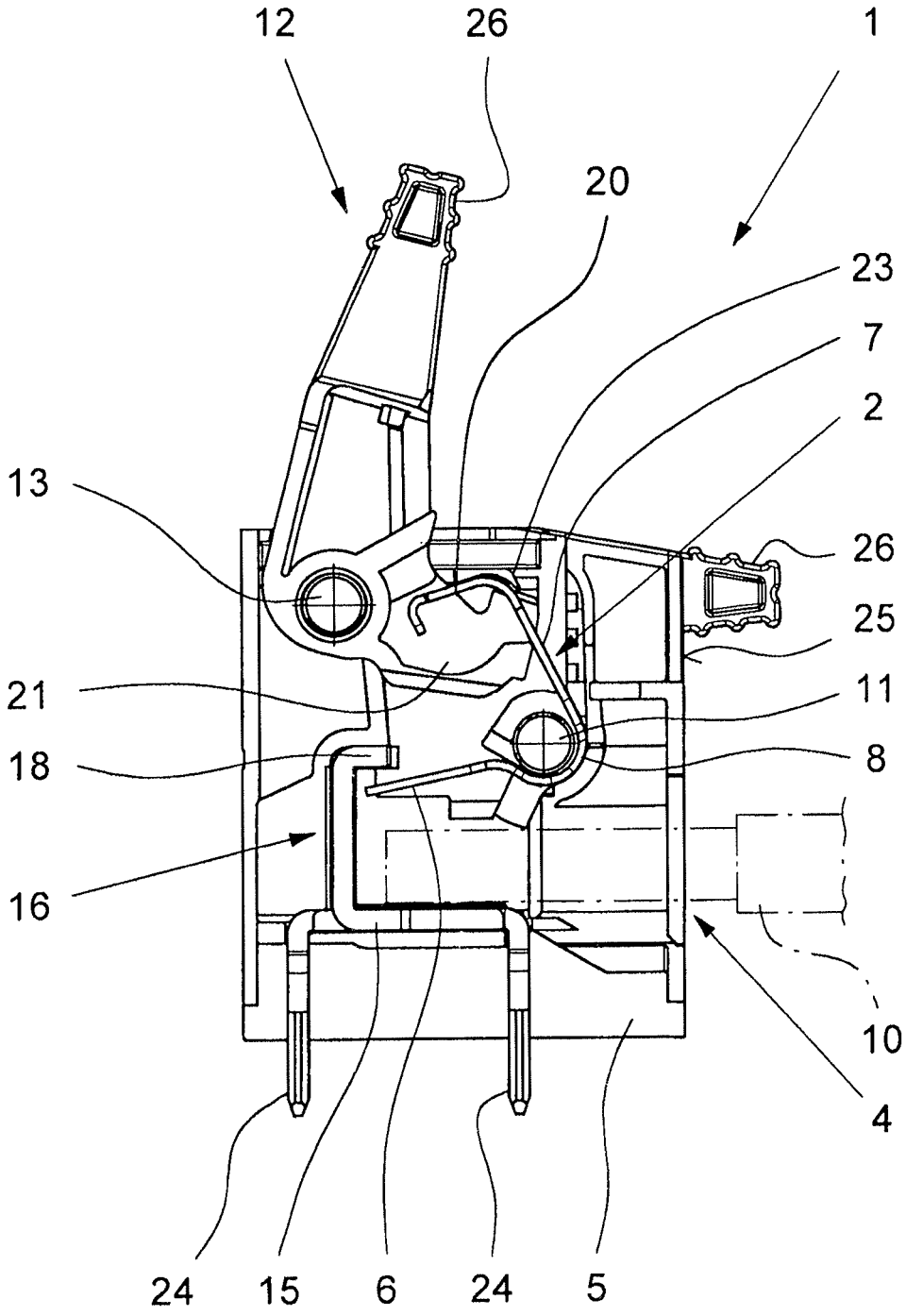
FIG. 3 shows an electrical terminal in the completely opened state, in a side view.
Figure 5:
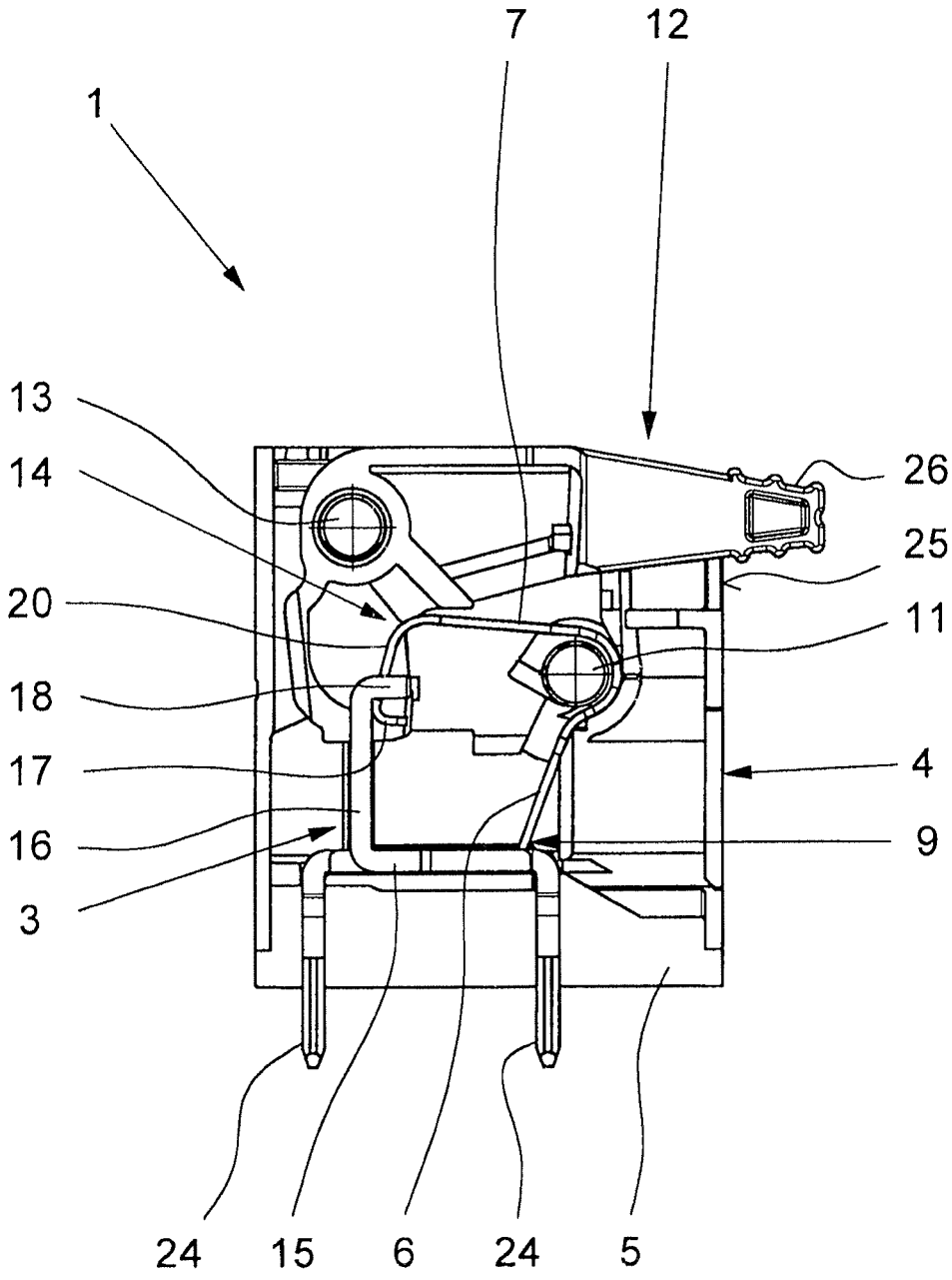
FIG. 5 shows the terminal as shown in FIG. 3, in the closed position.
Figure 6:
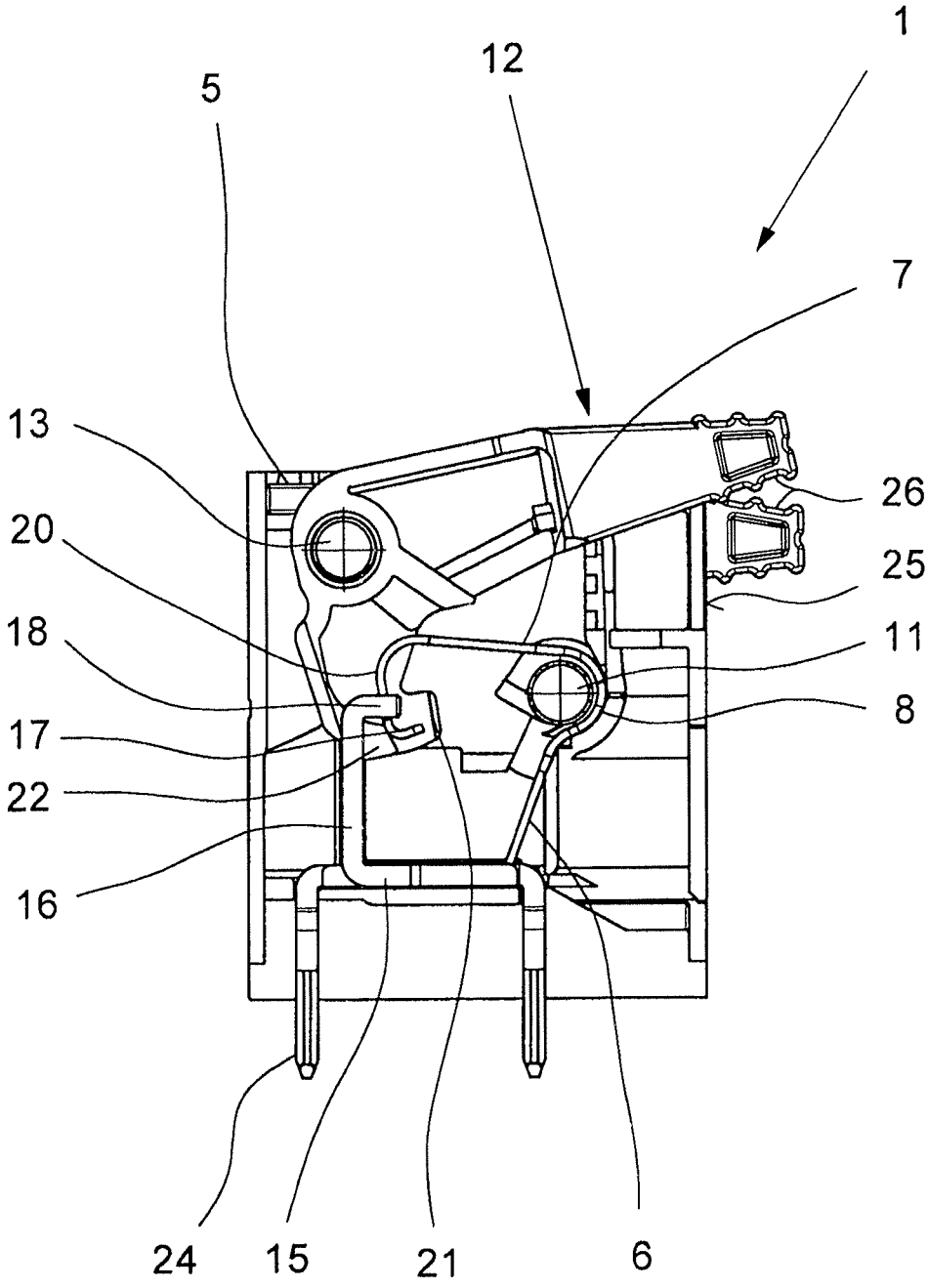
FIG. 6 shows the terminal as shown in FIG. 3, at the start of the opening process

The clamping spring 2 has a clamping leg 6, an actuating leg 7 and a back 8 which connects the two legs 6, 7 to one another, the clamping leg 6 forms with the metal part 3 a clamping site 9 for a stripped conductor 10 which is to be connected (shown only in FIG. 3). In the housing 5, a journal 11 is made on which the clamping spring 2 is supported to be able to pivot such that the clamping spring 2 can be pivoted out of a first (opened) position (FIGS. 1 and 3) into a second (closed) position (FIGS. 2, 5, and 6). In the first position of the clamping spring 2, a stripped electrical conductor 10 which has been inserted through the conductor insertion opening 4 in the first position of the clamping spring can be inserted into the clamping site 9, without the clamping leg 6 having to be deflected against its spring force or the spring force of the clamping spring 2. In the second position of the clamping spring 2 the electrical conductor 10 is clamped in an electrically conductive manner between the end of the clamping leg 6 and the metal part 3, the clamping leg 6 being deflected out of its rest state.

The actuation of the electrical terminal 1 takes place in an especially user-friendly manner in that in the housing 5 an actuating element 12 is mounted to be able to pivot on a second journal 13. When the actuating element 12 is pivoted out of the first (opened) position (FIG. 1) into its second (closed) position (FIG. 2), the clamping spring 2 is pivoted out of its first position into its second position by pivoting of the actuating element 12. The electrical terminal 1 can thus be closed by pressing the pivotally mounted actuating element 12 down and can be opened again by pivoting the actuating element 12 into the opposite direction.

Figure 4:
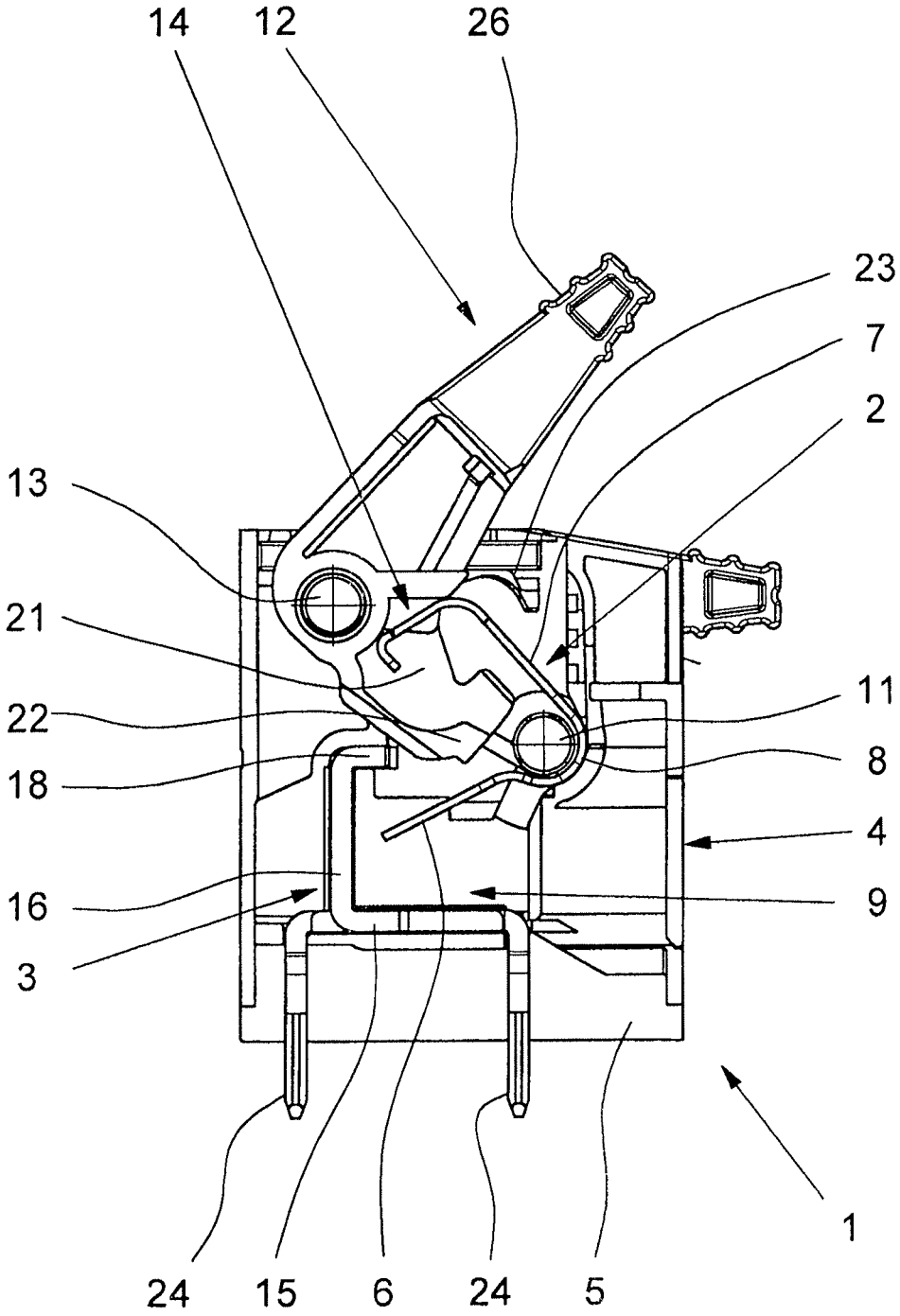
FIG. 4 shows the terminal as shown in FIG. 3 when pivoted into the second, closed position.
Figure 7:
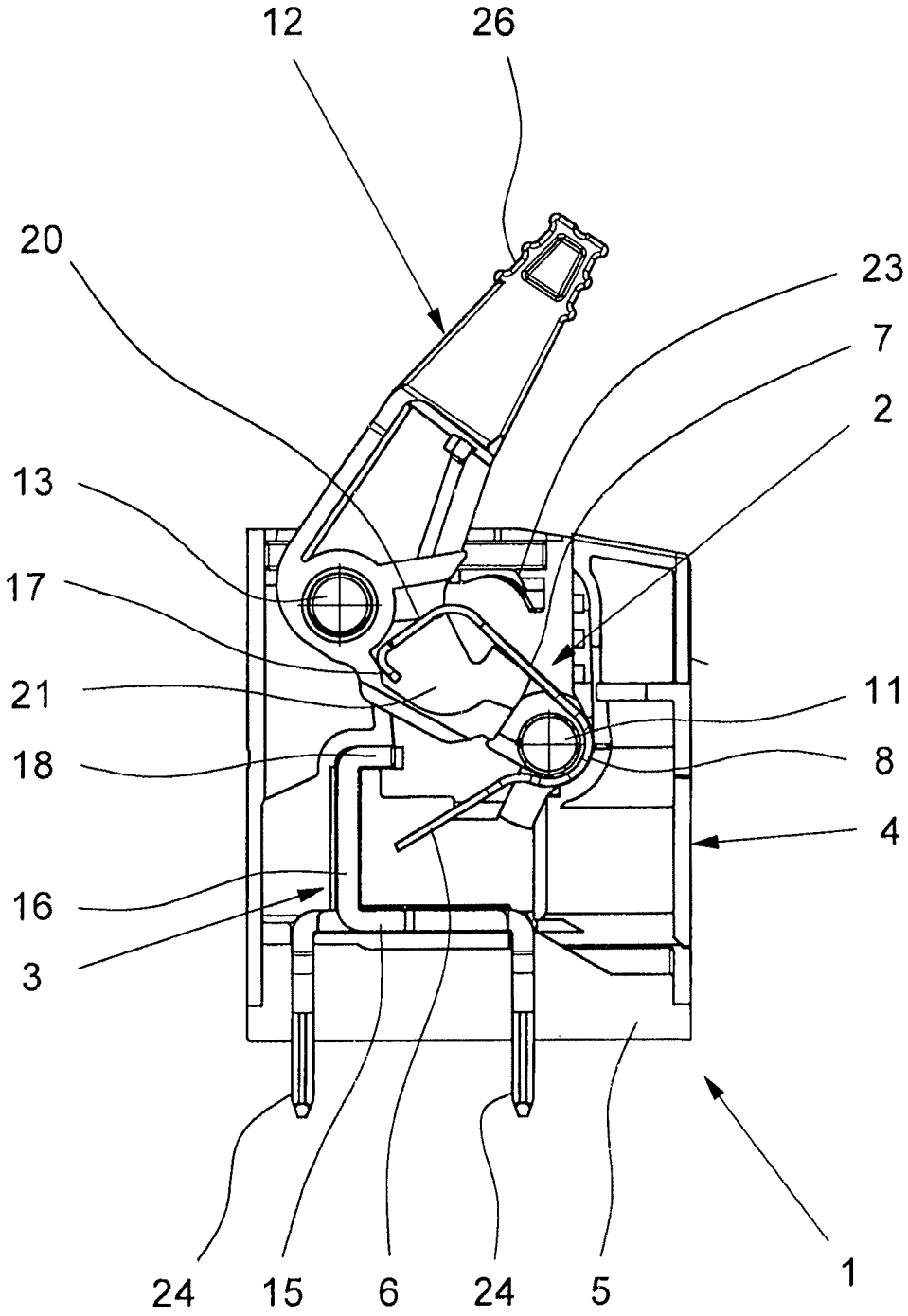
FIG. 7 shows the terminal as shown in FIG. 3, in the almost completely opened state.

FIGS. 3 to 5 show the closing process of the clamping spring 2 at three successive instants while FIGS. 6 and 7 show the opening process at two instants. In the arrangement and orientation of the electrical terminal 1 shown in the figures, the actuating element 12 must be pivoted clockwise for closing and counterclockwise for opening, i.e., the actuating element 12 is pressed down for closing and pivoted up for opening. As is apparent from the figures, when the actuating element 12 is being closed, the clamping spring 2 is pivoted counterclockwise and when the actuating element 12 is being opened, it is pivoted clockwise, i.e., the direction of turning and pivoting of the clamping spring 2 and the direction of turning and pivoting of the actuating element 12 are opposite one another.

Due to the illustrated arrangement of the clamping spring 2 and the actuating element 12 and their support on the journals 11 and 13, the clamping spring 2 and the actuating element 12 engage one another so that the terminal 1 has small dimensions. Moreover, because the journal 13 of the actuating element 12 is located near the end of the actuating leg 7, only a low torque acts on the actuating element 12 in the closed position of the actuating element 12.

As is especially apparent from FIGS. 2 and 5, the clamping spring 2 is locked in its second position so that the clamping spring 2 after connecting an electrical conductor 10 as a result of its pivotable arrangement and as a result of its spring force does not pivot back in the direction of the first position. For this purpose, the actuating leg 7 of the clamping spring 2 on its end which is away from the clamping leg 6 has a retaining section 14 which is bent in the direction of the clamping leg 6. Corresponding thereto, the metal part 3, in addition to a clamping section 15, has a retaining section 16 which is bent away from it in the direction of the actuating leg 7. In the preferred exemplary embodiment of the terminal 1 shown in the figures, locking between the retaining section 14 of the actuating leg 7 and the retaining section 16 of the metal part 3 is implemented by two projections 17 which protrude laterally to the outside being formed on the retaining section 14 of the actuating leg 7 and the retaining section 16 of the metal part 3 having two separate bent catch ends 18. In the locked state of the clamping spring 2 as shown in FIG. 2, the projections 17 are locked under the catch ends 18 so that the clamping spring 2 is held in its closed position and cannot pivot back into its opened position.

As is especially apparent from FIGS. 1 and 2, the retaining section 14 of the actuating leg 7 has two retaining legs 20 which are separated from one another by a slot 19, on each of the two retaining legs 20 one of the two projections 17 at a time being formed. By forming two separate retaining legs 20, the deflection of the two retaining legs 20 is facilitated when the clamping spring 2 is locked in the second position. Moreover, the ends of the two retaining legs 20 are bent to the inside, i.e., in the direction to the clamping leg 6 so that the retaining legs 20 do not jam on the catch ends 18 when the actuating leg 7 is pressed down by the actuating element 12.

In order to open the clamping spring 2, and thus, to facilitate the pivoting of the clamping spring 2 out of the second position into the first position, the actuating element 12 has an actuating wall 21 and two unlocking sections 22 which are made laterally next to the actuating wall 21. The actuating wall 21 extends in the plane of the slot 19 which is formed in the retaining section 14 of the actuating leg 7 so that the actuating wall 21 can dip into the slot 19 when the clamping spring 2 is pivoted out of the closed position into the opened position. When the clamping spring 2 is pivoted out of the closed position into the opened position, as is shown in FIGS. 6 and 7, first the two actuating sections 22 press against the two retaining legs 20 of the retaining section 14, as a result of which the locking between the projections 17 and the catch ends 18 is released.

If a conductor 10 is inserted in the electrical terminal 1 so that the clamping leg 6 is deflected against the spring force of the clamping spring 2, the clamping spring 2, after releasing the locking, first, pivots itself into the partially opened position as a result of its spring force, as is shown in FIG. 7. In order to pivot the clamping spring 2 into the completely opened position which is shown in FIGS. 1 and 3, the actuating element 12 must be pivoted up, i.e., counterclockwise in the orientation of the terminal 1 shown in the figures. Here, the actuating wall 21 of the actuating element 12 slides through the slot 19 in the retaining section 14 of the actuating leg 7 until the end of the actuating wall 21 from the inside strikes the actuating leg 7 so that as the actuating element 12 continues to pivot the clamping spring 2 is also further pivoted into the completely opened position. The completely opened position of the clamping spring 2 is then reached when the clamping spring 2 with its actuating leg 7 strikes the stop 23 which is made in the housing 5. In this way, the completely opened position of the clamping spring 2 can also be easily recognized for the mechanic.

The exemplary embodiment of the terminal 1 in accordance with the invention shown in the figures is a print terminal for connecting a conductor 10 to a circuit board. For this purpose, the metal part 3 has several, in the illustrated exemplary embodiment, four, solder terminal prints 24 are connected in one piece to the metal part 3. The metal part 3 can thus be produced from a conductive flat material as a simple punched and bent part. Likewise, the clamping spring 2 can be made of a flat material that is brought into its shape shown in the figures by punching out and bending.

For simple and convenient handling of the actuating element 12, it has a grip section 26 which projects over the end surface 25 of the housing 5. The actuating element 12 can thus be pivoted easily with one or two fingers—according to FIGS. 3 to 5—out of the first position into the second position, i.e., closed, and with one or two fingers—according to FIGS. 6 and 7—out of the second position into the first position, i.e., opened.

What is claimed is:

1. Electrical terminal comprising:

a clamping spring having a clamping leg, an actuating leg, and a back which connects the legs to each other, a metal part and a housing which holds the clamping spring and the metal part, the housing having at least one conductor insertion opening, wherein the clamping leg forms with the metal part a clamping site for a stripped conductor which is to be connected, wherein the clamping spring is pivotably mounted to one of the housing and the metal part so as to be movable between a first, opened, position, in which a stripped electrical conductor is insertable into a clamping site, without the clamping leg having to be deflected against its spring force, into a second, closed, position in which the inserted stripped electrical conductor is clamped in an electrically conductive manner between an end of the clamping leg and the metal part, and wherein an actuating element is pivotably supported in the housing so as to be movable between a first position and a second position, the clamping spring being pivoted out of its said first position into its said second position when the actuating element is pivoted out of its said first position into its said second position.

2. Electrical terminal as claimed in claim 1, wherein the clamping spring is pivoted out of its said second position into its said first position when the actuating element is pivoted out of its said second position into its said first position.

3. Electrical ten final as claimed in claim 1, wherein the clamping spring and the actuating element are arranged and supported in the housing so as to pivot in opposite directions.

4. Electrical terminal as claimed in claim 1, wherein the clamping spring is lockable in its said second position.

5. Electrical terminal as claimed in claim 4, wherein the actuating leg has a retaining section on an end which is away from the clamping leg, the retaining section being bent in toward the clamping leg and wherein the metal part has a clamping section and a retaining section which is bent away from the clamping section, the clamping leg and the clamping section forming the clamping site, and wherein the retaining section of the actuating leg and the retaining section of the metal part are lockable with one another in the second position of the clamping spring.

6. Electrical terminal as claimed in claim 5, wherein at least one catch element is provided on the retaining section of the actuating leg and at least one corresponding mating catch element is provided on the retaining section of the metal part.

7. Electrical terminal as claimed in claim 6, wherein two outwardly directed projections are formed on the retaining section of the actuating leg and wherein the retaining section of the metal part has two separate bent catch ends so that the clamping springs are fixable in the second position by the projections locking under the catch ends.

8. Electrical terminal as claimed in claim 5, wherein, when the actuating element is pivoted out of the second position into the first position, the retaining section of the actuating leg is deflected by the actuating element such that the locking between the retaining section of the actuating leg and the retaining section of the metal part is released.

9. Electrical terminal as claimed in claim 8, wherein the retaining section of the actuating leg has two retaining legs which are separated from one another by a slot.

10. Electrical terminal as claimed in claim 9, wherein the actuating element has an actuating wall which is located in a plane of the slot and two unlocking sections which are located laterally next to the actuating wall, when the actuating element is pivoted out of the second position into the first position, first the unlocking sections of the actuating element release the locking between the retaining section of the actuating leg and the retaining section of the metal part and then the actuating wall presses against the actuating leg so that the clamping spring is pivoted out of its second position into its first position.

11. Electrical terminal as claimed in claim 1, wherein a stop is provided in the housing against which the clamping spring lies in the first position of the clamping spring.

12. Electrical terminal as claimed in claim 1, wherein the metal part is connected in an electrically conductive manner to at least one solder terminal pin.

13. Electrical terminal as claimed in claim 1, wherein the actuating element has a grip section which projects over an end surface of the housing.

* * * * *